US007728777B2

(12) United States Patent
Gapski et al.

(10) Patent No.: US 7,728,777 B2
(45) Date of Patent: Jun. 1, 2010

(54) ANTENNA DEVICE FOR RADIO TELEPHONES

(75) Inventors: Dietmar Gapski, Bocholt (DE); Stephan Herrmann, Bottrop (DE)

(73) Assignee: Gigaset Communications GmbH, Munich (DE)

( * ) Notice: Subject to any disclaimer, the term of this patent is extended or adjusted under 35 U.S.C. 154(b) by 219 days.

(21) Appl. No.: 11/922,677

(22) PCT Filed: Apr. 12, 2006

(86) PCT No.: PCT/EP2006/061555

§ 371 (c)(1),
(2), (4) Date: Dec. 21, 2007

(87) PCT Pub. No.: WO2007/000360

PCT Pub. Date: Jan. 4, 2007

(65) Prior Publication Data

US 2009/0231209 A1 Sep. 17, 2009

(30) Foreign Application Priority Data

Jun. 29, 2005 (DE) ..... 10 2005 030 384

(51) Int. Cl.
*H01Q 1/24* (2006.01)

(52) U.S. Cl. ..... 343/702; 343/700 MS

(58) Field of Classification Search ..... 343/702, 343/700 MS, 846, 873
See application file for complete search history.

(56) References Cited

U.S. PATENT DOCUMENTS

| | | | | |
|---|---|---|---|---|
| 5,737,323 | A | 4/1998 | Lansdowne | |
| 6,101,371 | A | 8/2000 | Barber et al. | |
| 6,504,511 | B2 | 1/2003 | Andersson | |
| 6,957,080 | B2 * | 10/2005 | Guetre et al. | 455/552.1 |
| 2002/0030627 | A1 * | 3/2002 | Cassel | 343/702 |
| 2004/0150569 | A1 * | 8/2004 | Proctor et al. | 343/702 |

(Continued)

FOREIGN PATENT DOCUMENTS

DE 20112076 U1 10/2001

(Continued)

OTHER PUBLICATIONS

English translations of Abstracts for WO 2004/066444 A1, DE 101 24 766 C1, WO 01/80355 A1, DE 102 59 839 A1, EP 0 986 106 A1, DE 696 22 451 T2, DE 201 12 076 U1 and FR 2 748 161.

*Primary Examiner*—HoangAnh T Le
(74) *Attorney, Agent, or Firm*—Staas & Halsey LLP

(57) ABSTRACT

An antenna device for radio telephone based on a printed circuit board antenna or a strip conductor antenna and simple to produce and has a high efficiency, but nevertheless ensures that the user of the radio telephone is less exposed to the effects of electromagnetic radiation and the parasitic interference of the telephone caused by the user is reduced. To this end, the strip conductor carrier is cut around strip conductors used as the antenna up to a section used for the connection of the strip conductor used as the antenna to the other strip conductors of the strip conductor carrier. Furthermore, at least when the strip conductor carrier is mounted in the radio telephone, the cut-out regions of the strip conductor carrier, carrying the strip conductor used as the antenna is deflected out of the plane of the other regions of the strip conductor carrier.

6 Claims, 2 Drawing Sheets

U.S. PATENT DOCUMENTS

2009/0040115 A1 * 2/2009 Zhang et al. ..... 343/702

FOREIGN PATENT DOCUMENTS

| | | | |
|---|---|---|---|
| DE | 69622451 | T2 | 2/2003 |
| DE | 10124766 | C1 | 5/2003 |
| DE | 10259839 | A1 | 3/2005 |
| EP | 0986106 | A1 | 3/2000 |
| FR | 2 748 161 | | 10/1997 |
| WO | WO 0180355 | A1 | 10/2001 |
| WO | WO 2004066444 | A1 | 8/2004 |

* cited by examiner

ANTENNA DEVICE FOR RADIO TELEPHONES

CROSS REFERENCE TO RELATED APPLICATIONS

This application is based on and hereby claims priority to PCT/EP2006/061555, filed Apr. 12, 2006 and to German Application No. 10 2005 030 384.6 filed on Jun. 29, 2005, the contents of which are hereby incorporated by reference.

BACKGROUND OF THE INVENTION

The invention relates to an antenna device for radio telephones.

Radio telephones have an antenna, with the aid of which a wireless connection can be established with corresponding associated transmitter/receiver stations.

Basically there are three possible ways of implementing antennas in a radio telephone.

Firstly, it is possible to use an additional external component as the antenna.

Such an implementation is known for example from the document DE 696 22 451 T2.

The antenna device implemented in accordance with this document comprises an additional antenna component which is brought out from the housing of the radio telephone in question.

Although such an antenna device represents an optimum solution in terms of antenna technology, this solution is however no longer acceptable today in practical terms at least in the mass market for reasons of design.

Secondly, it is possible to use an additional internal component as the antenna.

Such an implementation is known for example from the document DE 102 59 839 A1.

The antenna device implemented in accordance with this document comprises an additional antenna component which can for example be a sheet-metal part or wireframe geometry. In this case, this additional antenna component includes regions which are arranged outside the plane of a carrier used for the antenna arrangement, but also for further electrotechnical precautions. Compared with an arrangement of the antenna device on the same plane as the aforementioned carrier this results in an increased distance between the head of a user of the radio telephone in question and the antenna device of this telephone. In this manner the head of the user is less exposed to the effects of electromagnetic radiation emitted by the telephone. On the other hand, however, the parasitic interference of the radio telephone or its antenna caused by the user is also reduced.

In a side view disclosed in the last-mentioned document said increased distance with respect to the antenna and the strip conductor carrier can be easily seen.

One disadvantage of such an antenna device is the fact that an additional component is used for the antenna, which is expensive to manufacture and complex to assemble.

Thirdly, it is possible to use a printed circuit board antenna or a strip conductor antenna.

Such an implementation is known for example from the document DE 201 12 076 U1.

An antenna device of this type essentially has only one strip conductor as an antenna, which is arranged directly on a strip conductor carrier.

One important disadvantage of this antenna device is the fact that the distance from the strip conductor used as the antenna to an outer wall of the associated radio telephone and thus to the head of a user of said radio telephone is very small. Here too this small distance between radio telephone and head again causes an undesired distortion of the radiation pattern of the antenna device of the telephone in addition to increased exposure of the head of a user of the radio telephone to the electromagnetic radiation emitted by the telephone. As a result, radiation losses due to absorption are again caused which are reflected in a reduced range of the telephone. To compensate for this would mean increasing the radiated power, which in turn results in increased irradiation of high-frequency power into the head of the user.

A loop antenna is known from the document EP 0 986 106 A1, which is arranged with its loop element spaced from the plane of the carrier material carrying the loop antenna by material tensioning of guide elements.

An antenna construction is known from the document WO 2004/066444 A1, which is formed with the aid of a flexible, film-like substrate. On the flexible substrate are placed antenna elements together with both electronics elements and electrical feed lines. The flexible substrate is applied on an upper side of a circuit board and covers the entire upper surface of the latter. In this case it is embodied in such a manner that it projects beyond the upper surface of the circuit board. The part of the flexible substrate, on which the antenna elements are placed, projecting beyond the circuit board is bent back in an arc across the upper surface of the circuit board and forms a second plane at a spacing from the upper surface of the circuit board. The distance between this second plane and the upper surface of the circuit board is fixed by spacers arranged between them.

A similar antenna is disclosed in the document DE 101 24 766 C1, as is known from the document WO 2004/066444 A1.

SUMMARY OF THE INVENTION

One possible object, on the basis of an antenna device of a type described in the introduction, is to improve the antenna device technically in such a manner that it is economical and simple to produce, that it has a high degree of efficiency but nevertheless ensures that the user of the radio telephone in question is less exposed to the effects of electromagnetic radiation and the parasitic interference of the telephone caused by the user is reduced.

To this end the strip conductor carrier, on which the strip conductor used as the antenna is applied, is cut around the strip conductor used as the antenna apart from a section used for the connection of the strip conductor used as the antenna to the other strip conductors of the strip conductor carrier. Furthermore, at least when the strip conductor carrier is mounted in the radio telephone, the cut-out region of the strip conductor carrier, carrying the strip conductor used as the antenna, is deflected out of the plane of the other regions of the strip conductor carrier.

This type of antenna device for radio telephones combines the cost-effective aspect and the advantageous aspect of ease of manufacture of printed circuit board antennas with the advantages of an increased distance between the strip conductor used as the antenna and the head of a user of the radio telephone. As a result of this increased distance, the technical effect on a user during operation of the antenna are reduced. On the other hand, the parasitic interference of the antenna caused by the user is also reduced, such that the efficiency of the antenna is in turn increased as a result.

The manufacture of a printed circuit board antenna in general and particularly the manufacture of the printed circuit board antenna are simple because the manufacture of the printed circuit board antenna can be integrated into the production process for printed circuit board manufacture. No additional parts that are complex to assemble are required. This thereby saves additional material and the resources required to equip it, for which a special pick and place machine may even be necessary under certain circumstances. Through the savings made by not using a special pick and place machine for example, it is also possible to save on cycle time during production.

Furthermore, a supporting element is provided in the radio telephone, through which, when the strip conductor carrier is mounted in the radio telephone the cut-out region of the strip conductor carrier, carrying the strip conductor used as the antenna, is held pushed out from the plane of the other regions of the strip conductor carrier by a reversibly sprung restoring force.

The advantage of the device is that no separate work step is required in order to deflect the region of the strip conductor carrier, carrying the strip conductor used as the antenna, out of the plane of the other regions of the strip conductor carrier before the strip conductor carrier is mounted in the radio telephone. This is accomplished automatically by corresponding and appropriately arranged supporting elements in the radio telephone when the strip conductor carrier is mounted in the radio telephone. Due to the fact that the deflection of the region of the strip conductor carrier, on which the strip conductor used as the antenna is situated, is effected with a reversibly sprung restoring force, a situation resulting in the formation of cracks or even breaks in the strip conductor used as the antenna is avoided.

A further advantage is the fact that the strip conductor used as the antenna does not only need to be straight. It can instead even exhibit a curved shape or a mixture of rectilinearity and curvature. This means that extremely small from a second angle of view.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1:
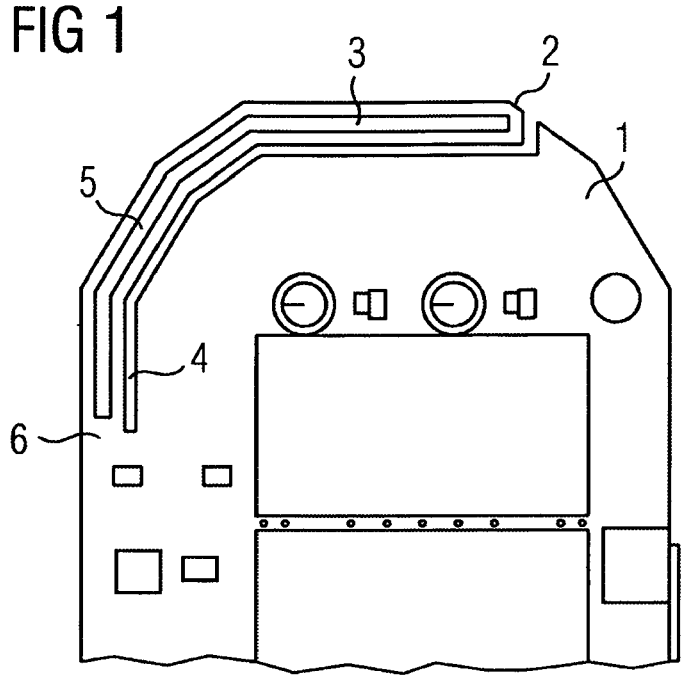
FIG. 1 shows a strip conductor carrier having an antenna device according to one potential embodiment in a stage prior to mounting the strip conductor carrier in a radio telephone.

Reference will now be made in detail to the preferred embodiments of the present invention, examples of which are illustrated in the accompanying drawings, wherein like reference numerals refer to like elements throughout.

Figure 2:
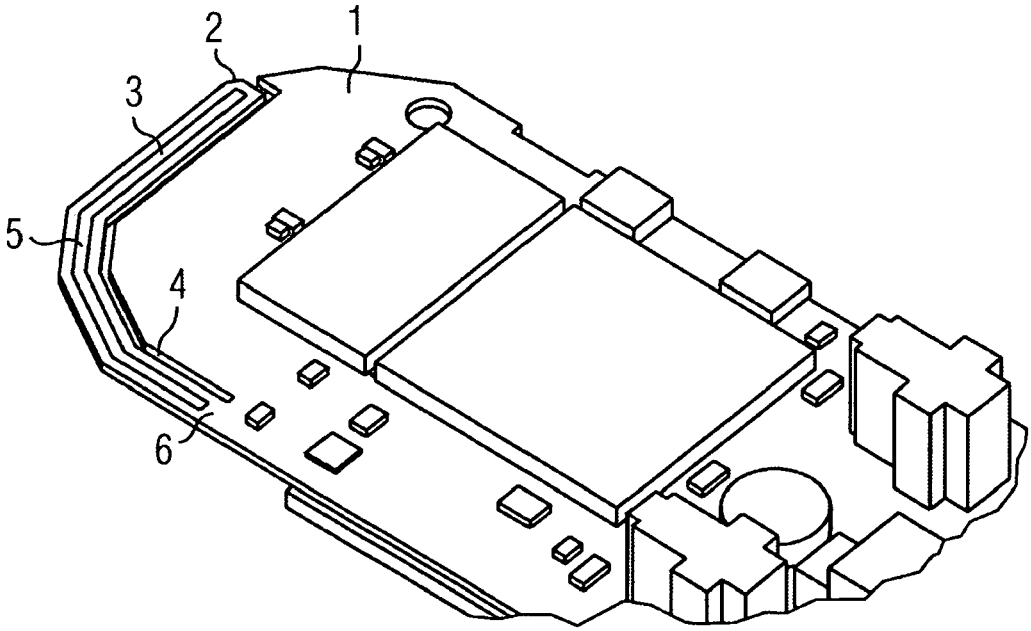
FIG. 2 shows a strip conductor carrier according to FIG. 1 in a three-dimensional view.

As illustrated by FIGS. 1 and 2, the strip conductor carrier 1 for a radio telephone (not shown in more detail in the figures) has an antenna device 2 which is arranged at one edge of the strip conductor carrier 1. The antenna device 2 includes a strip conductor 3 which forms the actual antenna. The strip conductor carrier 1 is partially machined away with an open-ended cut 4 around the strip conductor 3 acting as the antenna. In this manner a flexible part 5 is obtained, on which the strip conductor 3 used as the antenna is located. Given an appropriate choice of material for the strip conductor carrier 1, this part is sufficiently tensile and thus be pushed into any position. The open-ended cut 4 is chosen such that a segment 6 still remains to attach it to the rest of the strip conductor carrier 1, which amongst other things is used to provide a connection for connecting the strip conductor 3 used as the antenna to the other strip conductors of the strip conductor carrier 1.

Figure 3:
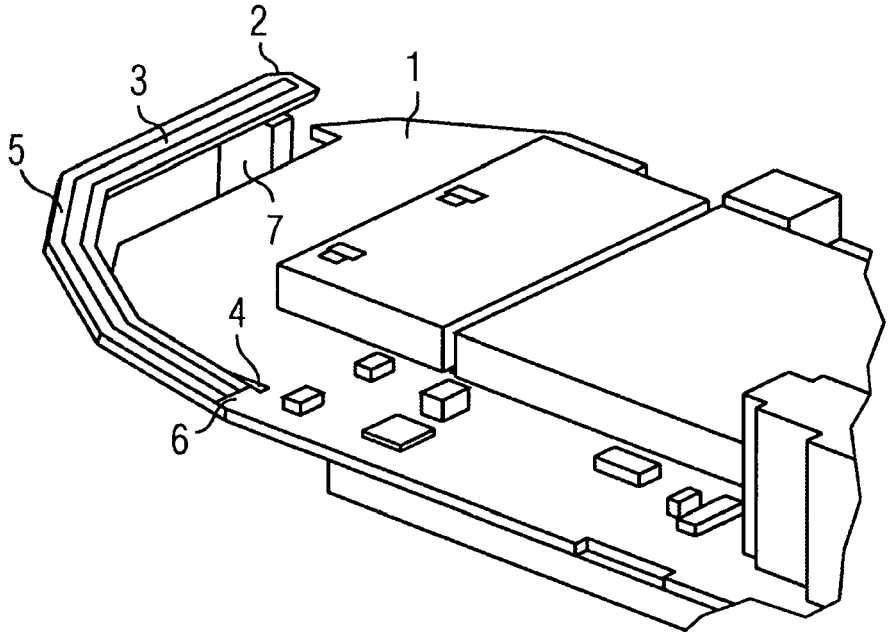
FIG. 3 shows a strip conductor carrier having an antenna device in a stage after mounting the strip conductor carrier in a radio telephone and in a three-dimensional view.
Figure 4:
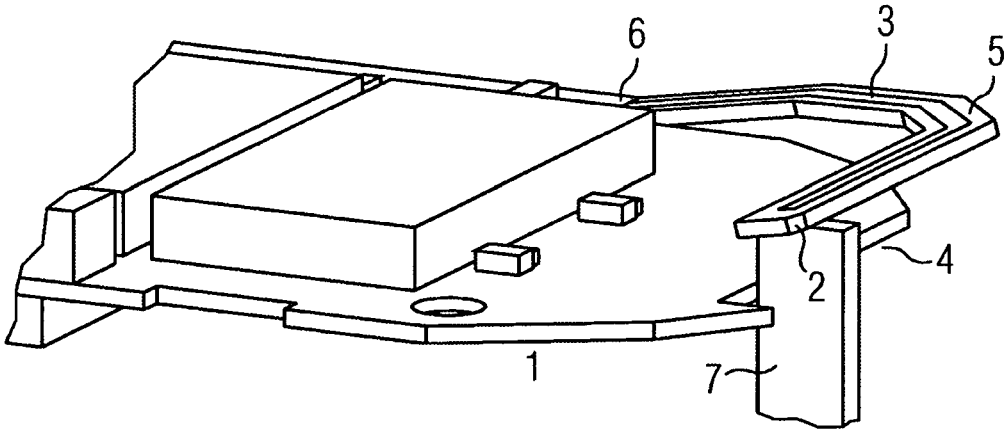
FIG. 4 shows a strip conductor carrier according to FIG. 3 from a second angle of view.

As illustrated in FIGS. 3 and 4, when the strip conductor carrier 1 is mounted in a radio telephone (not shown in detail in the figures) the sprung part 5 in the case (not shown in detail in the figures) of the radio telephone is pushed up by a corresponding supporting element 7, for example an appropriately shaped and placed rib as an example of a technical medium performing such a function. By this means the flexible part 5 is deflected out of the plane of the other regions of the strip conductor carrier 1 with respect to said plane against a reversibly sprung restoring force.

The direction of the deflection of the flexible part 5 is chosen such that the strip conductor 3 used as the antenna is directed away from a user of the radio telephone.

As FIGS. 1 to 4 together show, the flexible part 5 on which the strip conductor 3 used as the antenna is situated has a curved form. In these embodiments this corresponds to the shape of the casing stop at this point of the radio telephone into which the illustrated strip conductor carrier 1 is to be incorporated. Other forms of embodiment for this flexible part 5 are however also conceivable.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in *Superguide v. DIRECTV,* 69 USPQ2d 1865 (Fed. Cir. 2004).

The invention claimed is:

1. An antenna device for a radio telephone, comprising:

a strip conductor carrier;

a strip conductor formed on one edge of the strip conductor carrier, the strip conductor being connected to other conductors on the strip conductor carrier so that the strip conductor serves as an antenna for the radio telephone, the strip conductor carrier being cut around the strip conductor to define a cut-out region and a connection section, the connection section connecting the strip conductor to the other conductors on the strip conductor carrier, the cut-out region carrying the strip conductor; and a supporting unit provided in the radio telephone to deflect the cut-out region and the strip conductor out of a plane of the connection section at least when the strip conductor carrier is mounted in the radio telephone, the supporting unit deflecting the cut-out region and the strip conductor against a reversibly sprung restoring force of the cut-out region.

2. The antenna device as claimed in claim 1, wherein the strip conductor is in a straight form.

3. The antenna device as claimed in claim 1, wherein the strip conductor is in a curved form.

4. The antenna device as claimed in claim 1, wherein the cut-out region and the strip conductor are deflected in a direction away from a user of the radio telephone.

5. The antenna device as claimed in claim 2, wherein the cut-out region and the strip conductor are deflected in a direction away from a user of the radio telephone.

6. The antenna device as claimed in claim 3, wherein the cut-out region and the strip conductor are deflected in a direction away from a user of the radio telephone.

* * * * *